United States Patent [19]

Miller

[11] Patent Number: 4,785,143

[45] Date of Patent: Nov. 15, 1988

[54] SAFETY EDGE FOR A DOOR

[76] Inventor: Norman K. Miller, 1 Concord Industrial Park, Concordville, Pa. 19331

[21] Appl. No.: 85,561

[22] Filed: Aug. 17, 1987

[51] Int. Cl.[4] ..... H01H 3/16; E05F 15/00

[52] U.S. Cl. ..... 200/61.43

[58] Field of Search ..... 200/61.43, 86 R, 86 A; 49/26, 27, 28

[56] References Cited

U.S. PATENT DOCUMENTS

| | | | |
|---|---|---|---|
| 3,315,080 | 4/1967 | Miller | 200/61.43 |
| 4,045,631 | 8/1977 | Dann | 200/61.43 |
| 4,051,336 | 9/1977 | Miller | 200/61.43 |
| 4,066,851 | 1/1978 | White et al. | 200/86 R X |
| 4,396,814 | 8/1983 | Miller | 200/61.43 |

*Primary Examiner*—J. R. Scott

*Attorney, Agent, or Firm*—Robert K. Youtie

[57] ABSTRACT

A safety door edge switch including a flexible sheath, an internal resiliently compressible foam formation in the sheath and providing fluid communication therealong, a relatively rigid transverse structure at one region in the sheath and containing a pressure sensitive switch element communicating with the inner formation for sensing pressure throughout the sheath and a pair of spaced confronting flexible contact sheaths engageable to provide a secondary switch.

6 Claims, 1 Drawing Sheet

FIG. 1
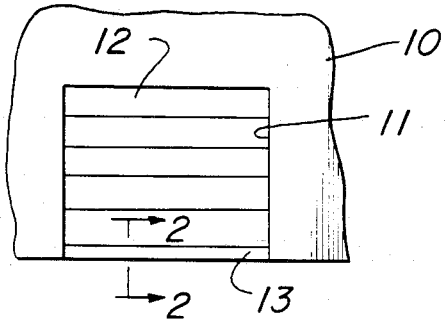
FIG. 2
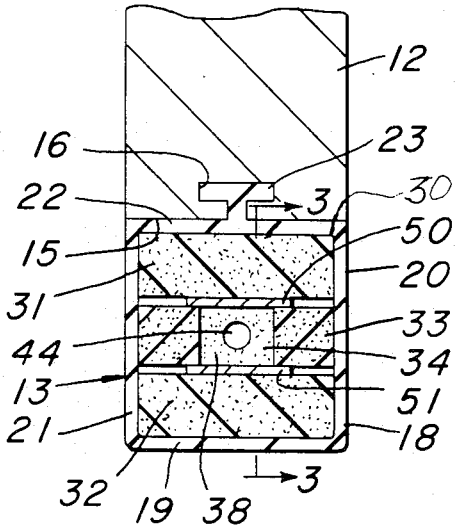
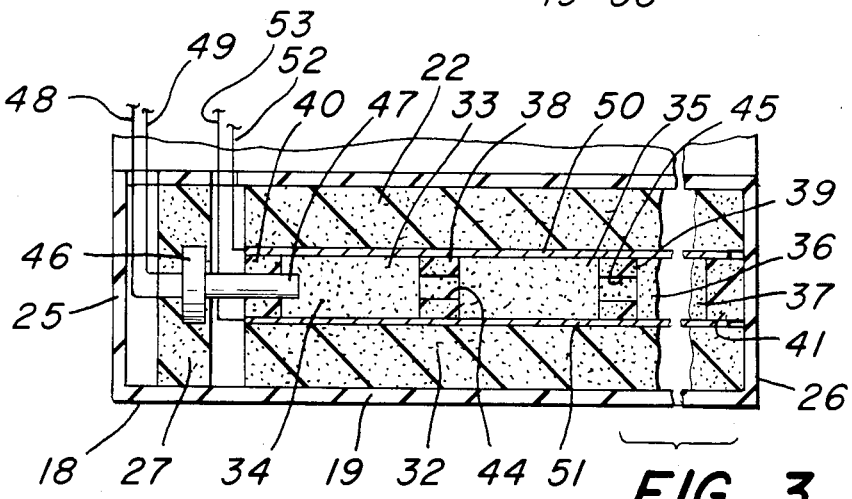
FIG. 3

SAFETY EDGE FOR A DOOR

BACKGROUND OF THE INVENTION

This invention is concerned with safety door edges as in heavy over-head doors to protect personnel, equipment, and the door from damage by impact; as well as for use in doors for elevators, mass transit vehicles, and the like, wherein an extremely high degree of reliability is a requirement, as well as substantial versatility for use under many different circumstances.

SUMMARY OF THE INVENTION

It is an important object of the present invention to provide a door edge switch construction for use in the broad field discussed above, wherein may be obtained extremely high sensitivity to external pressure, as well as the reliability of a back-up or redundant switch system, which may be selectively employed as a plural switch system for actuating a plurality of operators.

It is a more particular object of the present invention to provide a highly improved safety door edge switch having the advantageous characteristics mentioned in the preceeding paragraph wherein a pressure sensitive switch element may be protectively encased in the door edge construction itself, as well as the door edge provided with internal contact elements for connection to an exterior circuit as a redundant, alternative, sequential, or other desired combination of switches.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope is indicated by the appended claims.

BRIEF DESCRIPTION OF THE DRAWINGS

FIG. 1 is an elevational view showing a door construction including a safety edge of the present invention.

FIG. 2 is a transverse sectional elevational view taken generally along the line 2—2 of FIG. 1, enlarged for clarification.

FIG. 3 is a longitudinal sectional elevational view taken generally along the line 3—3 of FIG. 2.

BRIEF DESCRIPTION OF THE PREFERRED EMBODIMENT

Referring now more particularly to the drawings, a building wall is shown at 10 in FIG. 1, having a doorway 11 provided with a door 12. While the door illustrated at 12 is an overhead door, having a safety edge 13 of the present invention along its lower side or leading edge, the device of the present invention is equally applicable for use with vertically disposed, horizontally moveable doors and other closures, as desired.

The safety edge 13, see FIG. 2, extends along the lower or leading edge 15 of the door 12, which door portion may be provided with an elongate, female dovetail or similar configuration, as at 16.

The door edge construction 13 may include an outer casing or sheath 18 of elongate, generally constant cross-sectional outline configuration, extending closely along the underside or edge 15 of the door 12. The casing or sheath 18 may advantageously be fabricated of form retaining, but flexible material, such as rubber, having a bottom wall 19 for engagement with the door threshold or ground, side walls 20 and 21 upstanding integrally from opposite side edges of the bottom wall, and a top wall 22 extending between upper edges of the side walls in close facing relation with the leading door edge 15. The sheath 18 may be further formed with a male, dovetail formation 23 upstanding along the top wall 22 for interfitting engagement with the door edge formation 16, facilitating quick and easy mounting, removal and replacement of the door edge 13 with respect to the door 12.

Opposite ends of the sheath 18 are closed and sealed, as by end walls 25 and 26, and provided interiorly of the sheath 18, at least at one region thereof, is a relatively stiff or rigid transverse formation, as at 27, extending entirely across the sheath, so as to effectively prevent or minimize compression of the sheath at that location. In the illustrated embodiment, the relatively stiff or rigid transverse structure 27 is shown at one end, the left hand end of the sheath. The relatively rigid structure 27 may be of a configuration conformable to the internal cross-sectional configuration of the sheath 18, and fabricated of relatively stiff material, such as firm rubber or plastic. If desired, more than one relatively incompressible transverse structures, as at 27, may be provided in the sheath 18, say at spaced locations therealong.

Substantially fully occupying the remainder of the sheath 18, except that occupied by the transverse structure 27 may be a resiliently compressible inner formation 30, extending longitudinally along the interior of the sheath. The compressible formation 30 is fabricated essentially of foam, and includes an elongate inner or upper foam strip 31 extending closely along the inner side of the sheath top wall 22, substantially co-extensive therewith, except for the space occupied by the transverse structure 27.

A similar lower, or outer foam strip 32 may be substantially congruent to the upper or inner foam strip 31, being in generally parallel, facing, spaced relation with respect to the latter, and extending closely along and substantially co-extensive with the lower or outer sheath wall 19. That is, the outer foam strip 32 substantially completely occupies the interior face of the outer sheath wall 19, except for that occupied by the transverse structure 27.

In addition, an intermediate foam strip 33 is interposed in sandwiched relation between the inner and outer foam strips 31 and 32, being of an outline configuration substantially congruent to that of the inner and outer foam strips. However, the intermediate foam strip 33 is provided with a plurality of vertically extending, through openings, as at 34, 35, 36 and 37 arranged in a series or row longitudinally of the intermediate strip, and spaced apart from each other by transverse partitions or walls, as at 38 and 39 remaining between the openings or through holes. Also, the openings or through holes 34–37 are spaced from the end surfaces of the intermediate strip 33 to leave end walls, as at 40 and 41, for the end openings or holes 33 and 37.

As the vertically extending, through holes or openings 34–37 are interposed between the upper and lower foam strips 31 and 32, it will be apparent that the openings are closed by the upper and lower strips, and combine therewith to define essentially closed cavities or chambers of the openings 34–37.

It is essential that the several openings or chambers 34–37 be in fluid communication with each other, in order to transmit therebetween pressure changes occurring by external pressure applied to the sheath 18. If desired, the foam of the intermediate layer 33 may be of the open cell type for communication between chambers 34–37 through the cells of the partitions 38 and 39. Alternatively, the foam of intermediate layer 33 may be of the closed cell type where this structure is desirable, and there be provided passageways or conduits through the intermediate partitions 38 and 39, as at 44 and 45.

Protectively located in the relatively rigid transverse structure 27, as at 46, is a fluid pressure sensitive switch element, which may be of the type manufactured by Micro Pneumatic Logic, Inc. of Fort Lauderdale, Fla., or equivalent. The pressure sensitive switch element 46 is effectively protected, as by imbedding or otherwise enclosing within the rigid structure 27, and includes a pressure port or nipple 47 communicating through the end partition and into the adjacent end chamber 34. The pressure sensitive switch element 46 is provided with electrical conductors as at 48 and 49 extending in sealed relation outwardly from the sheath 18 for connection in desired control circuitry.

Thus, the pressure sensitive switch element 46 is in pneumatic communication from its mounting in the transverse structure 27 throughout the entire interior of the sheath 18 through the fluid passage means defined by the series of openings 34–37 and intermediate conduit means, as at 44 and 45. Thus, upon the application of external pressure to the sheath 18, anywhere therealong except at the location of structure 27, increased internal pressure in the several chambers 34–37 is communicated to the switch element 46 to actuate the latter for effecting a desired result. Further, the switch is protectively enclosed in the transverse structure, which also serves upon normal ground engagement of the door 12, to prevent pressure increase and actuation of the switch element.

In addition to the foregoing, the present invention may include a pair or upper and lower, flexible, conductive sheets, say of aluminum foil or the like, as at 50 and 51. These conductive sheets are on opposite, upper and lower sides of the intermediate foam strip, being respectively sandwiched therebetween and the upper and lower foam strips 31 and 32. That is the upper or inner conductive sheet 50 is sandwiched between the intermediate foam strip 33 and upper foam strip 31, while the lower or outer conductive sheet is sandwiched between the intermediate foam strip and the lower or outer foam strip 32. The upper and lower conductive sheets 50 and 51 extend, respectively, over and under the several openings 34–37 in the intermediate strip, being in spaced, confronting relation with respect to each other through the several openings. Upon the application of external pressure to the sheath 18 except at the location of transverse structure 27, the conductive sheets 50 and 51 may be deflected into and through a respective chamber for electrically conductive engagement with each other. Connected to respective conductive sheets 50 and 51 are conductors 52 and 53, which may pass in sealed relation exteriorly of the sheath 18 for connection to suitable circuitry. Thus, the conductive sheets 50 and 51 combine to define a pressure sensitive switch construction in addition to that of switch 46.

The relative sensitivity may be selected, as by adjustment of the switch element 46 and selection of the densities and thicknesses of foam elements 31, 32 and 33. If desired, the switch construction of sheets 50 and 51 may be redundant to or a back-up for that of switch element 46, or vice-versa. Further, one switch element may operate in sequence with the other, as for controlling a plurality of separate functions, as in the stopping and reversing of door movement, or other desired functions, all for great reliability and versatility in operation.

Although the present invention has been described in some detail by way of illustration and example for purposes of clarity of understanding, it is understood that certain changes and modifications may be made within the spirit of the invention.

What is claimed is:

1. A safety edge for a door or the like comprising an elongate outer sheath fabricated of flexible air impervious material and adapted for attachment to a door edge, airtight end closures on said sheath, an elongate inner formation of resiliently compressible foam configured to conformably occupy the interior of said outer sheath and being compressible under external pressure applied to said outer sheath, said inner foam including a longitudinally extending intermediate layer having transverse through openings defining therebetween partitions having longitudinal openings communicating between the transverse through openings, and a substantially rigid incompressible transverse structure in one region of said sheath, and having a configuration conforming to the interior cross-section of said sheath to effectively prevent deformation of the sheath, and fluid passage means communicating from said one region throughout the remaining interior region of said sheath, and a pressure sensitive switch element protectively located in said transverse structure within said sheath for sensing pressure change throughout said sheath without subjecting the switch element to external pressure.

2. A safety edge according to claim 1, said one region being located at one end of said sheath.

3. A safety edge according to claim 1, said foam formation comprising a pair of longitudinally extending inner and outer strips, and an intermediate strip interposed between said inner and outer strips, said fluid passage means being defined by a plurality of openings in said intermediate strip providing interior air chambers, and air conduit means communicating between said air chambers.

4. A safety edge according to claim 3, in combination with a pair of flexible conductive sheets on opposite sides of said intermediate strip respectively sandwiched between the latter and said inner and outer strips and in spaced confronting relation through said openings, said conductive sheets being displacable through said openings into electrical engagement under external pressure applied to said sheath to define an alternate pressure sensitive switch.

5. A safety edge according to claim 3, said intermediate strip being of closed formation and having a passageway providing said conduit means.

6. A safety edge according to claim 1, said one region being at one end of said sheath, to leave the remainder of said sheath sensitive to pressure change.

* * * * *